US011289810B2

(12) United States Patent
Lyu

(10) Patent No.: US 11,289,810 B2
(45) Date of Patent: Mar. 29, 2022

(54) MULTI-BAND ANTENNA

(71) Applicants: Inventec (Pudong) Technology Corporation, Shanghai (CN); INVENTEC CORPORATION, Taipei (TW)

(72) Inventor: Chao-An Lyu, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 224 days.

(21) Appl. No.: 16/711,454

(22) Filed: Dec. 12, 2019

(65) Prior Publication Data

US 2021/0151885 A1 May 20, 2021

(30) Foreign Application Priority Data

Nov. 15, 2019 (CN) ..... 201911120474.9

(51) Int. Cl.

| | |
|---|---|
| ***H01Q 5/307*** | (2015.01) |
| ***H01Q 1/48*** | (2006.01) |
| ***H01Q 9/42*** | (2006.01) |
| ***H01Q 5/10*** | (2015.01) |
| ***H01Q 9/04*** | (2006.01) |
| ***H01Q 5/385*** | (2015.01) |

(52) U.S. Cl.

CPC ..... *H01Q 5/307* (2015.01); *H01Q 1/48* (2013.01); *H01Q 5/10* (2015.01); *H01Q 9/42* (2013.01); *H01Q 5/385* (2015.01); *H01Q 9/0457* (2013.01)

(58) Field of Classification Search

CPC ..... H01Q 5/371; H01Q 5/378; H01Q 9/0457; H01Q 5/40; H01Q 5/385; H01Q 5/328

See application file for complete search history.

(56) References Cited

U.S. PATENT DOCUMENTS

| | | | | |
|---|---|---|---|---|
| 2005/0156795 | A1* | 7/2005 | Yeh | H01Q 11/04 343/702 |
| 2012/0274538 | A1* | 11/2012 | Tsou | H01Q 5/371 343/876 |
| 2013/0257674 | A1* | 10/2013 | Li | H01Q 5/378 343/853 |
| 2019/0296446 | A1* | 9/2019 | Tseng | H01Q 5/371 |

FOREIGN PATENT DOCUMENTS

| | | | |
|---|---|---|---|
| CN | 102709672 | B | 12/2014 |
| TW | 201036250 | A | 10/2010 |
| TW | I488358 | B | 6/2015 |
| TW | I508373 | B | 11/2015 |

* cited by examiner

*Primary Examiner* — Ricardo I Magallanes

(74) *Attorney, Agent, or Firm* — CKC & Partners Co., LLC

(57) ABSTRACT

A multi-band antenna includes a grounding conductor, a first radiator, and a second radiator. The grounding conductor has a grounding function. The first radiator has a first radiating portion, a second radiating portion, and a feeding portion configured to connect to a signal source. The second radiator includes a third radiating portion, a fourth radiating portion, and a first grounding portion. A length of the third radiating portion or a length of the fourth radiating portion is longer than lengths of first radiating portion and the second radiating portion combined, and the third radiating portion or the fourth radiating portion is radiationally coupled with the first radiating portion and the second radiating portion.

7 Claims, 2 Drawing Sheets

MULTI-BAND ANTENNA

CROSS-REFERENCE TO RELATED APPLICATION

This application claims priority to China Application Serial Number 201911120474.9, filed Nov. 15, 2019, which is herein incorporated by reference in its entirety.

BACKGROUND

Field of Invention

The present disclosure relates to an antenna, and more particularly, to a multi-band antenna.

Description of Related Art

At present, communication technology is widely used in various fields. Moreover, communication technology has gradually matured.

In order to achieve communication technology that is rich and versatile, antennas need to be applied in different frequency bands. However, the space in the communication device in which the antennas are disposed is limited. Additionally, if various different types of antennas are disposed in a communication device, it is even more necessary to design the antennas to occupy less space.

Accordingly, research in various industries has been focused on ways to develop a multi-band antenna which can be applied in different frequency bands and which occupies less space.

SUMMARY

An aspect of the disclosure is to provide an antenna module which can effectively solve the aforementioned problems.

According to some embodiments of the present disclosure, a multi-band antenna includes a grounding conductor, a first radiator, and a second radiator. The grounding conductor has a grounding function. The first radiator includes a first radiating portion, a second radiating portion, and a feeding portion configured to connect to a signal source. The second radiator includes a third radiating portion, a fourth radiating portion, and a first grounding portion. A length of the third radiating portion or a length of the fourth radiating portion is longer than lengths of the first radiating portion and the second radiating portion combined, and the third radiating portion or the fourth radiating portion is radiationally coupled with the first radiating portion and the second radiating portion.

According to some embodiments of the present disclosure, the third radiating portion or the fourth radiating portion is spaced from the first radiating portion and the second radiating portion by a distance of equal to or less than 2 mm.

According to some embodiments of the present disclosure, the first radiator and the second radiator are substantially T-shaped.

According to some embodiments of the present disclosure, the multiple-band antenna further includes a third radiator. The third radiator includes a second grounding portion and a fifth radiating portion, wherein a length of the fifth radiating portion is shorter than the length of the first radiating portion or the length of the second radiating portion, and the first radiating portion or the second radiating portion is radiationally coupled with the fifth radiating portion.

According to some embodiments of the present disclosure, the first radiating portion or the second radiating portion is spaced from the fifth radiating portion by a distance of equal to or less than 5 mm.

According to some embodiments of the present disclosure, the third radiator is substantially L-shaped.

According to some embodiments of the present disclosure, the multi-band antenna further includes an inductor, and the inductor is disposed on the third radiating portion or the fourth radiating portion.

According to some embodiments of the present disclosure, the inductor is a distributed inductor.

According to some embodiments of the present disclosure, the distributed inductor is formed by a conducting wire having a wire diameter that is equal to or less than 0.5 mm.

According to some embodiments of the present disclosure, the conducting wire is formed into a rectangular shape, a circle shape, an oval shape, or a triangle shape.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
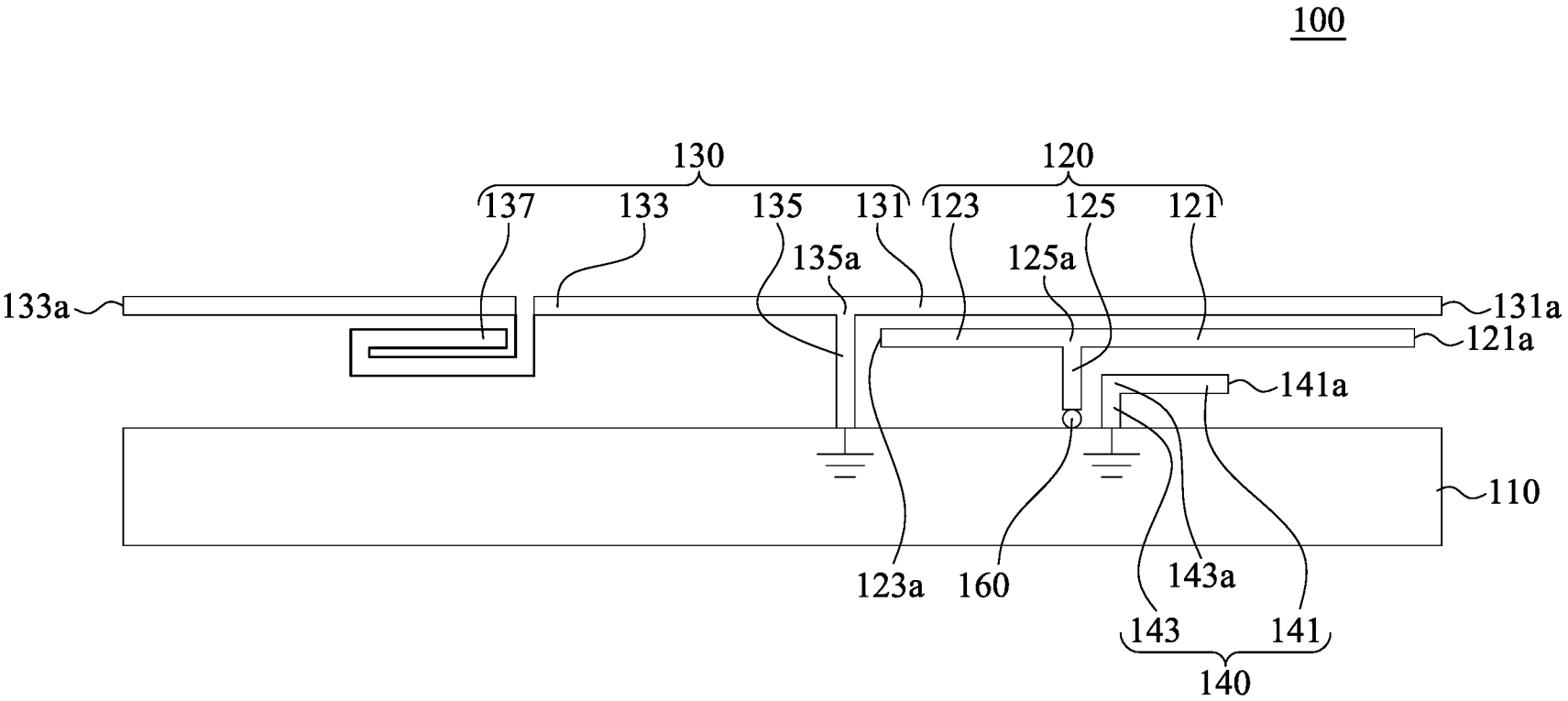
FIG. 1 is an equivalent schematic diagram of an embodiment of the present invention.

Reference will now be made in detail to the present embodiments of the disclosure, examples of which are illustrated in the accompanying drawings. Wherever possible, the same reference numbers are used in the drawings and the description to refer to the same or like parts.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the present disclosure. Reference throughout this specification to "one embodiment," "an embodiment", "some embodiments" or the like means that a particular feature, structure, configuration, or characteristic described in connection with the embodiment is included in at least one embodiment of the disclosure. Thus, the appearances of the phrase "in one embodiment," "in an embodiment", "in some embodiments" or the like in various places throughout this specification are not necessarily referring to the same embodiment of the disclosure. Furthermore, the particular features, structures, configurations, or characteristics may be combined in any suitable manner in one or more embodiments.

Reference is made to FIG. 1. In the first embodiment of the present disclosure, a multi-band antenna 100 includes a grounding conductor 110, a first radiator 120, and a second radiator 130. The grounding conductor 110 has a grounding function. The first radiator 120 includes a first radiating portion 121, a second radiating portion 123, and a feeding portion 125 configured to connect to a signal source 160. The signal source 160 feeds signals to the feeding portion 125. The second radiator 130 includes a third radiating portion 131, a fourth radiating portion 133, and a first grounding portion 135. A length of the third radiating portion 131 or the fourth radiating portion 133 is longer than lengths of the first radiating portion 121 and the second radiating portion 123 combined, and the third radiating portion 131 or the fourth radiating portion 133 is radiationally coupled with the first radiating portion 121 and the second radiating portion 123.

"Radiationally coupled" in the present disclosure refers to the phenomenon in which when a radiating part approaches an object (a conductor generally), a signal path is generated from a signal feeding point through a radiationally coupling point to the ground.

The first radiator 120 and the second radiator 130 are disposed on one side of the grounding conductor 110. The first radiator 120 extends toward opposite sides of the feeding portion. The first radiator 120 includes a first free end 121*a* and a second free end 123*a*. An end of the first radiator 120 connected to the signal source 160 is the feeding portion 125. The first radiator 120 extends toward opposite sides of the feeding portion 125, and two ends of the first radiator 120 located away from the feeding portion 125 are respectively the first free end 121*a* and the second free end 123*a*. Among the first free end 121*a*, the second free end 123*a*, and the feeding portion 125, a bend is formed at a first turning point 125*a* of the first radiator 120. The first radiating portion 121 is defined starting from the first free end 121*a* and extending to the feeding portion 125. The second radiating portion 123 is defined starting from the second free end 123*a* and extending to the feeding portion 125. Through the formation of the first radiating portion 121 and the second radiating portion 123 as described above, the first radiator 120 is substantially T-shaped.

The second radiator 130 includes a third free end 131*a* and a fourth free end 133*a*. An end of the second radiator 130 connected to the grounding conductor 110 is the first grounding portion 135. The second radiator 130 extends toward opposite sides of the first grounding portion 135, and the two ends of the second radiator 130 away from the first grounding portion 135 are respectively the third free end 131*a* and the fourth free end 133*a*. Among the third free end 131*a*, the fourth free end 133*a*, and the feeding portion 125, a bend is formed at a second turning point 135*a* of the second radiator 130. The third radiating portion 131 is defined starting from the third free end 131*a* and extending to the first grounding portion 135. The fourth radiating portion 133 is defined starting from the fourth free end 133*a* and extending to the first grounding portion 135. Through the formation of the third radiating portion 131 and the fourth radiating portion 133 as described above, the second radiator 130 is substantially T-shaped.

A length of the third radiating portion 131 or the fourth radiating portion 133 is longer than lengths of the first radiating portion 121 and the second radiating portion 123, which specifically means the length between the first grounding portion 135 and the third free end 131*a* or the length between the first grounding portion 135 and the fourth free end 133*a* is longer than the length between the feeding portion 125 and the first free end 121*a* and the length between the feeding portion 125 and the second free end 123*a*. That is, the radiation path of the third radiating portion 131 or the radiation path of the fourth radiating portion 133 is longer than the radiation path of the first radiating portion 121 and the radiation path of the second radiating portion 123. The present disclosure is not limited in this respect, and both the lengths of the third radiating portion 131 and the length of the fourth radiating portion 133 can be longer than the length of the first radiating portion 121 and the length of the second radiating portion. That is, both the radiation path of the third radiating portion 131 and the radiation path of the fourth radiating portion 133 may be longer than the radiation path of the first radiating portion 121 and the radiation path of the second radiating portion 123.

In the present embodiment, the first radiator 120 can be located within an area formed by the third radiating portion 131. That is, the first radiator 120 is located within the area formed starting from the third free end 131*a* and extending to the first grounding portion 135. The first radiator 120 can also be located within an area formed by the fourth radiating portion 133. That is, the first radiator 120 may be located within the area formed starting from the fourth free end 133*a* and extending to the first grounding portion 135.

In the present embodiment, one of the third radiating portion 131 and the fourth radiating portion 133, whichever is radiationally coupled to the first radiating portion 121 and the second radiating portion 123, is spaced from the first radiating portion 121 and the second radiating portion 123 by a distance of less than or equal to 2 mm to achieve a better radiationally coupling effect. Specifically, the portion between the first free end 121*a* and the second free end 123*a* of the first radiator 120 is spaced from the portion between the third free end 131*a* and the second turning point 135*a* of the second radiator 130 by a distance of less than or equal to 2 mm, or the portion between the first free end 121*a* and the second free end 123*a* of the first radiator 120 is spaced from the portion between the fourth free end 133*a* and the second turning point 135*a* of the second radiator 130 by a distance of less than or equal to 2 mm.

With continued reference to FIG. 1, in another embodiment of the present disclosure, the multi-band antenna 100 further includes a third radiator 140. The third radiator 140 includes a fifth radiating portion 141 and a second grounding portion 143. A length of the fifth radiating portion 141 is shorter than the length of the first radiating portion 121 or the length of the second radiating portion 123, and the first radiating portion 121 or the second radiating portion 123 is radiationally coupled with the fifth radiating portion 141.

The first radiator 120, the second radiator 130, and the third radiator 140 are disposed on one side of the grounding conductor 110. The third radiator 140 further includes a fifth free end 141*a*. An end of the third radiator 140 connected to the grounding conductor 110 is the second grounding portion 143, and the other end of the third radiator 140 away from the second grounding portion 143 is the fifth free end 141*a*. Between the second grounding portion 143 and the fifth free end 141*a*, a bend is formed at a third turning point 143*a* of the third radiator 140. The fifth radiating portion 141 is defined starting from the second grounding portion 143 and extending to the fifth free end 141*a*. Through this configuration, the third radiator 140 is substantially L-shaped.

The length of the fifth radiating portion 141 is shorter than the length of the first radiating portion 121 or the second radiating portion 123. Specifically, the length between the second grounding portion 143 and the fifth free end 141*a* is shorter than the length between the feeding portion 125 and the first free end 121*a* or the length between the feeding portion 125 and the second free end 123*a*. That is, the radiation path of the fifth radiating portion 141 is shorter than the radiation path of the first radiating portion 121 or the radiation path of the second radiating portion 123. The length between the second grounding portion 143 and the fifth free end 141*a* can also be shorter than the length between the feeding portion 125 and the first free end 121*a* and the length between the feeding portion 125 and the second free end 123*a*. That is, the radiation path of the fifth radiating portion 141 may be shorter than the radiation path of the first radiating portion 121 and the radiation path of the second radiating portion 123.

In the present embodiment, the third radiator 140 can be located within the area formed by the first radiating portion 121. That is, the third radiator 140 can be located within the area formed starting from the first free end 121*a* and extending to the feeding portion 125. The third radiator 140 can also be located within the area formed by the second radiating portion 123. That is, the third radiator 140 can also be located within the area formed starting from the second free end 123*a* and extending to the feeding portion 125. Users can adjust the configuration of the multi-band antenna 100 based on their requirements, and the present invention is not limited in this respect.

In the present embodiment, one of the first radiating portion 121 and the second radiating portion 123, whichever is radiationally coupled with the fifth radiating portion 141, is spaced from the fifth radiating portion 141 by a distance of less than or equal to 5 mm to achieve a better radiationally coupling effect. Specifically, the portion from the first free end 121*a* to the first turning point 125*a* is spaced from the portion from the fifth free end 141*a* to the third turning point 143*a* by a distance of less than or equal to 5 mm, or the portion from the second free end 123*a* to the first turning point 125*a* is spaced from the portion from the fifth free end 141*a* to the third turning point 143*a* by a distance of less than or equal to 5 mm.

With continued reference to FIG. 1, in the embodiment of the present disclosure, the second radiator 130 further includes an inductor 137, in which the inductor 137 is disposed on the third radiating portion 131 or the fourth radiating portion 133. The inductor 137 and the first radiator 120 are respectively located at opposite sides of the first grounding portion 135.

With the inclusion of the inductor 137, lengths of the radiating portions can be reduced. Specifically, when the inductor 137 is located between the third free end 131*a* and the second turning point 135*a*, the distance between the third free end 131*a* and the second turning point 135*a* can be reduced, and the radiation paths can still be maintained. Moreover, with the inclusion of the inductor 137, the multi-band antenna 100 can further acquire additional radiation paths, thereby allowing for miniaturization and multi-frequency band uses.

The inductor 137 can be a distributed inductor which is formed by a conducting wire having a wire diameter that is equal to or less than 0.5 mm. The conducting wire is coupled to the third radiating portion 131 or the fourth radiating portion 133, and the coupled one of the third radiating portion 131 and the fourth radiating portion 133 can split into two sections. The two sections are respectively coupled to the two ends of the conducting wire. The conducting wire bends to form the distributed inductor but the conducting wire does not overlap and intersect itself.

In the present embodiment, the conducting wire substantially bends into a rectangle shape. The present invention is not limited in this respect. The conducting wire can also substantially bend into a circle shape, an oval shape, or a triangle shape. In the case of a rectangle shape, the shape formed by the bending of the conducting wire extends toward the grounding conductor 110. Specifically, the two ends of the conducting wire extend toward the grounding conductor 110, then turn 90 degrees and extend in the same direction, then turn 90 degrees and extend away from the grounding conductor 110, and then turn 90 degrees and extend toward the direction where the conducting wire connects to a radiating portion to form a closed circuit. The present invention is not limited to such a configuration.

Figure 2:
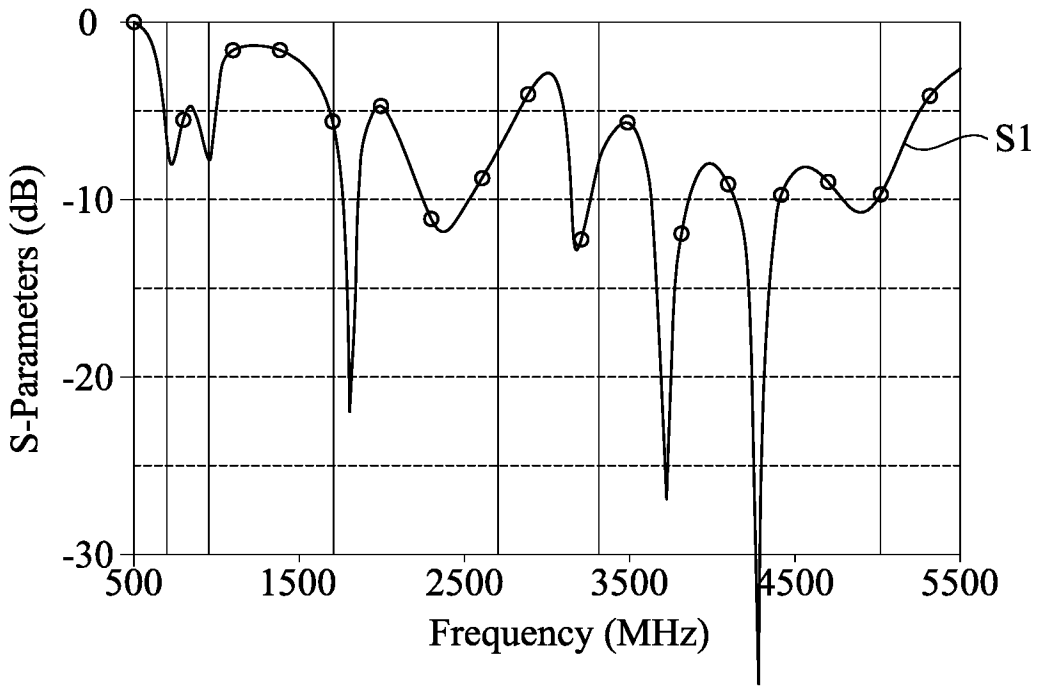
FIG. 2 is a comparison diagram of return loss for the embodiment shown in FIG. 1.

Reference is now made to FIG. 2. FIG. 2 is a comparison diagram of return loss for the embodiment shown in FIG. 1. It is evident from the curve S1 that the multi-band antenna 100 can be applied in various frequency bands. Moreover, the curve S1 clearly includes eight different troughs, indicating that the multi-band antenna 100 has eight resonance frequency points. Therefore, multi-band antenna 100 can be applied in eight different frequency bands.

In summary, since the first radiating portion, the second radiating portion, and the third radiating portion mutually radiationally couple with each other, the multi-band antenna in the present disclosure can acquire additional radiation paths. Therefore the multi-band antenna can be applied in various frequency bands. Moreover, based on the configuration of the inductor, the occupied space of the antennas can be reduced, thereby allowing for miniaturization of communication devices.

Although the present disclosure has been described in considerable detail with reference to certain embodiments tin this respect, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A multi-band antenna, comprising:

a grounding conductor with a grounding function;

a first radiator comprising a first radiating portion, a second radiating portion, and a feeding portion configured to connect to a signal source;

a second radiator comprising a third radiating portion, a fourth radiating portion, and a first grounding portion, wherein a length of the third radiating portion or a length of the fourth radiating portion is longer than lengths of the first radiating portion and the second radiating portion combined, and the third radiating portion or the fourth radiating portion is radiationally coupled with the first radiating portion and the second radiating portion combined;

a third radiator comprising a second grounding portion and a fifth radiating portion, wherein a length of the fifth radiating portion is shorter than the length of the first radiating portion or the length the second radiating portion, and the first radiating portion or the second radiating portion is radiationally coupled with the fifth radiating portion; and an inductor disposed on the third radiating portion or the fourth radiating portion, wherein the inductor is a distributed inductor.

2. The multi-band antenna of claim 1, wherein the third radiating portion or the fourth radiating portion is spaced from the first radiating portion and the second radiating portion by a distance equal to or less than 2 mm.

3. The multi-band antenna of claim 1, wherein the first radiator and the second radiator are substantially T-shaped.

4. The multi-band antenna of claim 1, wherein the first radiating portion or the second radiating portion is spaced from the fifth radiating portion by a distance of equal to or less than 5 mm.

5. The multi-band antenna of claim 1, wherein the third radiator is substantially L-shaped.

6. The multi-band antenna of claim 1, wherein the distributed inductor is formed by a conducting wire having a wire diameter that is equal to or less than 0.5 mm.

7. The multi-band antenna of claim 6, wherein the conducting wire is formed into a rectangular shape, a circle shape, an oval shape, or a triangle shape.

* * * * *